United States Patent [19]

Schroder

[11] Patent Number: 4,937,701

[45] Date of Patent: Jun. 26, 1990

[54] SAFETY DEVICE FOR BURNING CANDLES

[76] Inventor: Virgil C. Schroder, 23 Aztec, Council Bluffs, Iowa 51501

[21] Appl. No.: 348,846

[22] Filed: May 8, 1989

[51] Int. Cl.[5] ..... F21L 19/00

[52] U.S. Cl. ..... 362/161; 362/294; 362/345; 362/373

[58] Field of Search ..... 362/101, 161, 181, 182, 362/294, 345, 373; 431/291, 289

[56] References Cited

U.S. PATENT DOCUMENTS

| | | | |
|---|---|---|---|
| 1,503,661 | 8/1924 | Mueur-Thym | 431/320 |
| 2,246,346 | 6/1941 | Carroll | 431/298 |
| 2,315,803 | 4/1943 | Lipari | 431/291 |
| 2,330,705 | 9/1943 | Hamblet | 431/291 X |
| 3,240,035 | 3/1968 | Anderson | 431/290 |
| 4,017,729 | 4/1977 | Frazier, Jr. | 431/291 X |
| 4,524,408 | 6/1985 | Minera | 362/163 |

*Primary Examiner*—Stephen F. Husar
*Attorney, Agent, or Firm*—Henderson & Sturm

[57] ABSTRACT

A safety device for burning candles including an outer vessel that holds a supply of water, an inner reflector cantainer that holds a small quantity of water, and a reversible footed candle holder that can be selectively positioned within the reflector to support candles of different sizes. the device provides cooling for the sidewall and base of the reflector to minimize the fire hazard associated with burning candles. One end of the reversible holder accommodates a candle while the other end provides a recess which is filled with cooling water to control the high heat level present when the candle burns to the bottom. An insert candle holder is also provided to allow the burning of small birthday-type candles.

18 Claims, 2 Drawing Sheets

SAFETY DEVICE FOR BURNING CANDLES

TECHNICAL FIELD

This invention relates to candle holders and more particularly to a fire-safe candle holder.

BACKGROUND ART

Conventional candle holders allow burning candles to bend to one side or fall. Also a large quantity of heat is transmitted to the base of the candle holder as the candle burns down. These occurrences can mar the supporting surface of the candle holder and even cause a house fire.

Even candle holders that include reflectors that surround the candle can be a fire hazard. Heat can crack the glass or other material forming the reflector, thereby allowing the molten wax and burning wick to fall to the supporting surface.

Those concerned with these and other problems recognize the need for an improved safety device for burning candles.

DISCLOSURE OF THE INVENTION

The present invention provides a safety device for burning candles including an outer vessel that holds a supply of water, an inner reflector container that holds a small quantity of water, and a reversible footed candle holder that can be selectively positioned within the reflector to support candles of different sizes. The device provides cooling for the sidewall and base of the reflector to minimize the fire hazard associated with burning candles. One end of the reversible holder accommodates a candle while the other end provides a recess which is filled with cooling water to control the high heat level present when the candle burns to the bottom. An insert candle holder is also provided to allow the burning of small birthday-type candles.

An object of the present invention is the provision of an improved safety device for burning candles.

Another object of the present invention is to provide a safety device for burning candles that minimize the inherent fire hazard.

A further object of the invention is the provision of a safety device for burning candles that accommodates the burning of a number of differently sized candles.

Still another object of the present invention is to provide a safety device for burning candles that is aesthetically appealing.

A still further object of the present invention is the provision of a safety device for burning candles that is convenient to use and easy to maintain.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
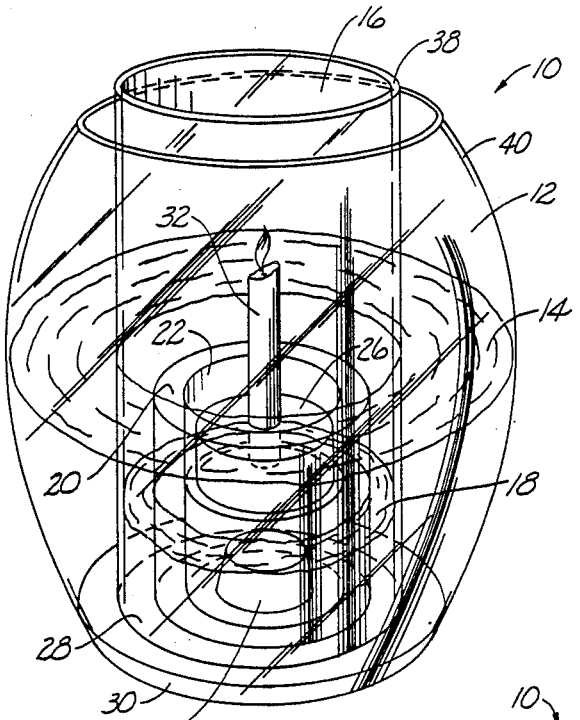
FIG. 1 is a perspective view of the safety device of the present invention illustrating the optional insert candle holder in use holding a small birthday candle.

Referring now to the drawings, wherein like reference numerals designate identical or corresponding parts throughout the several views, FIG. 1 depicts the safety device (10) for burning candles. The device (10) includes an open top vessel (12) which contains fluid (14). Seated in the interior of the vessel (12) is an open top reflector container (16) which contains a fluid (18). It is to be understood that the fluids (14, 18) could be water or any other non-flammable fluid.

When inserted into the vessel (12), the reflector (16) rests on the base (30) of the vessel (12). A reversible footed candle holder (20) is seated in the interior of the reflector (16) by resting on the base (28) of the reflector (16). A footed candle holder (20) includes candle receiving recesses (22, 24) for accommodating various sized candle bases. An insert candle holder (26) with a candle receiving recess (27) can also be added for accommodating a birthday type size candle (32).

Figure 2:
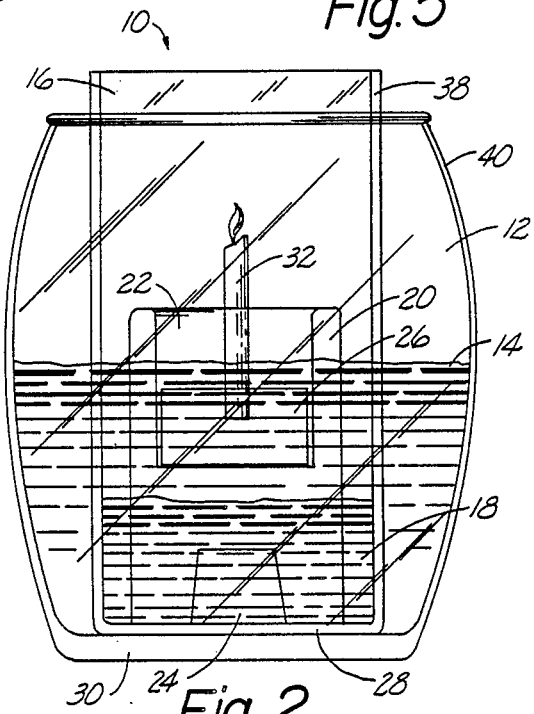
FIG. 2 is a side elevational view showing the relative positions of the outer fluid vessel, the inner reflector container, the reversible footed candle holder, and the insert candle holder together with a representative vessel fluid level and reflector fluid level.

Referring now to FIG. 2, the desired depths of fluid (14) of the vessel (12) and the fluid (18) of the reflector (16) are shown. The fluid (18) of the reflector (16) at a level below the top of the footed candle holder (20). The fluid (14) of the vessel (12) is of a depth to ensure that the reflector (16) and its contents do not float. The weight of the reflector (16) and its contents must, therefore, exceed the weight of the fluid (14) displaced.

Figure 3:
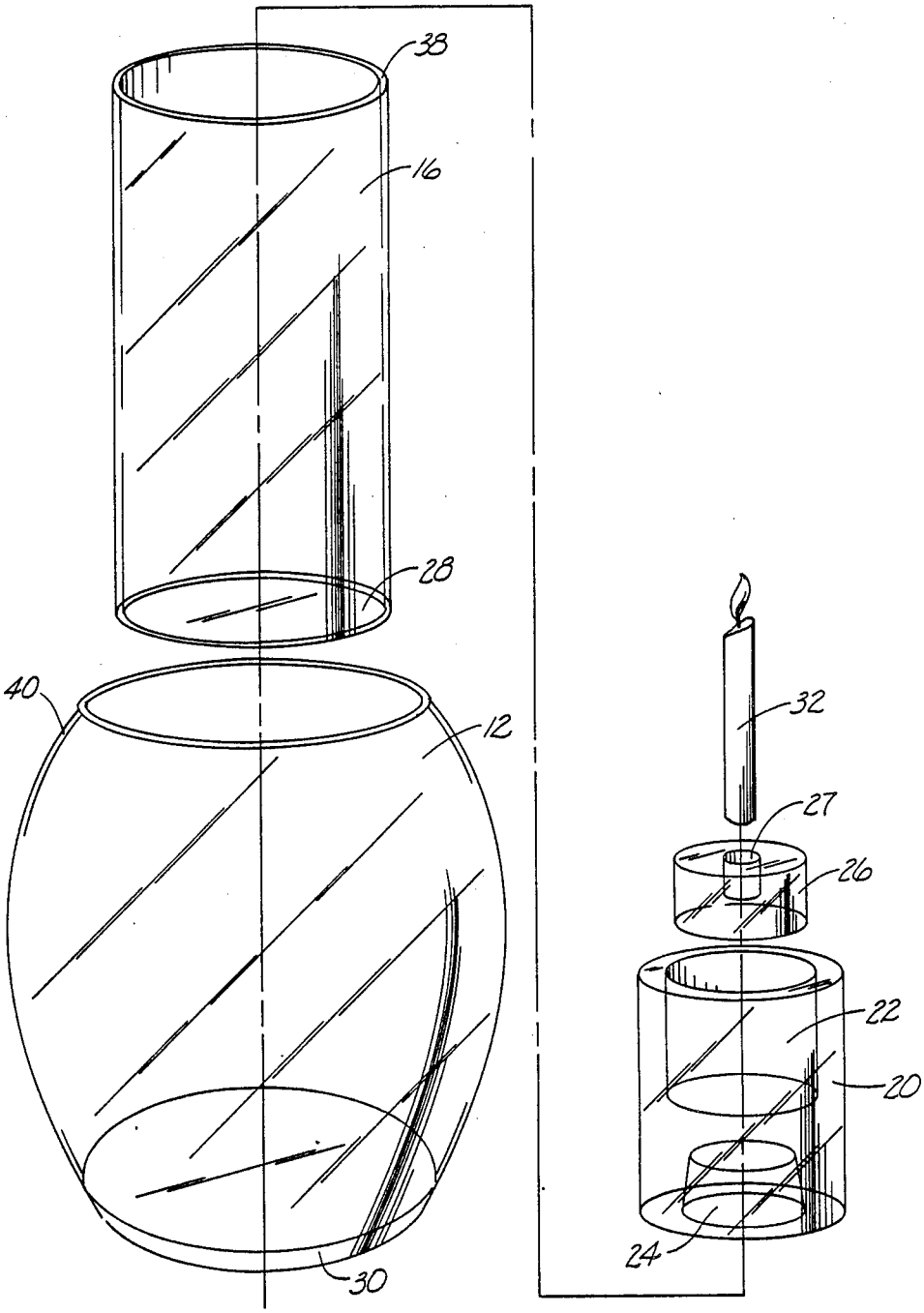
FIG. 3 is an exploded perspective view showing the components of the safety device.

FIG. 3 depicts the arrangement of the holder (20) and the insert (26) into the reflector (16) and into the vessel (12). It is to be understood that the reflector container (16) could be of various heights and the vessel (12) could be of various shapes other than that shown.

Figure 5:
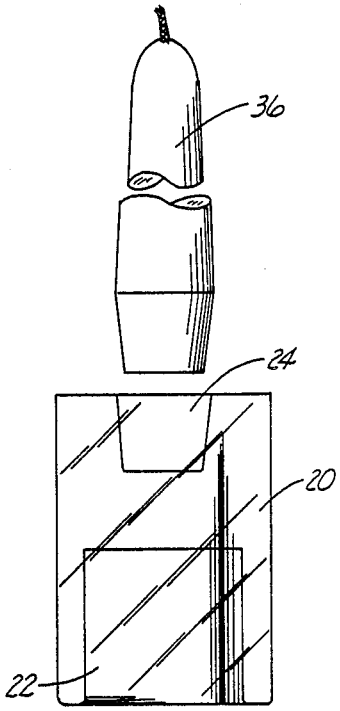
FIG. 5 is a side elevational view showing the footed candle holder reversed so that the smaller diameter recess is directed upwardly to receive a small diameter candle.
Figure 4:
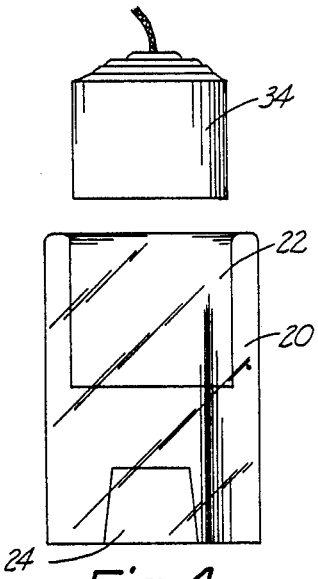
FIG. 4 is a side elevational view of the reversible candle holder with a larger diameter recess directed upwardly to receive a large diameter candle.

FIGS. 4 and 5 show the arrangement of a votive candle (34) into the larger recess (22) of the holder (20) and a taper candle (36) into the smaller recess (24) of the holder (20).

To use the invention (10) candle (32, 34, 36) is selected. If using a votive candle (34), the holder (20) would be turned to allow recess (22) to be in an upright position. Candle (34) is inserted into the recess (22). Likewise, if selecting a taper (36), the holder (20) would be turned to allow recess (24) to be in an upright position to hold taper (36). If a birthday type candle (32) is selected, an insert (26) is used and inserted into the holder (20). The holder (20) is then inserted into the reflector (16). An appropriate amount of fluid (18) is then poured down the sidewall (38) of the reflector (16). The fluid (18) will seep under the holder (20) and fill the void in the recess (22,24), depending on which recess is in an upright position, to allow cooling of the recess (22, 24) when the candle burns down to the recess. The reflector (16) is then inserted into the open top of the vessel (12). Fluid is poured down the sidewall (40) to a pleasing level. The candle (32, 34, 36) is then ignited by means well known in the art. After burning, the candle (32, 34, 36) is extinguished or allowed to burn out on its own. The fluid (18) will keep the candle (32, 34, 36)

from heating to a dangerous point if the candle (32, 34, 36) is allowed to burn out on its own. Likewise, the fluid (14) surrounding reflector (16) keeps the reflector (16) cool and minimizes breakage due to heat build up from a candle (32, 34, 36).

It should be noted that the fluids (14, 18) may be colored with an appropriate dye to correspond to any color scheme. By alternatively using a clear, frosted or patterned reflector (16) one can change the light thrown by the light of the candle being burned in the holder (20). Also, it is to be understood that the opacity of the components comprising the device (10) can range from opaque, to translucent, to transparent so that the appearance of the device (10) and the lighting effect can be infinitely varied.

Thus, it can be seen that at least all of the stated objectives have been achieved.

Obviously, many modifications and variations of the present invention are possible in light of the above teachings. It is therefore to be understood that, within the scope of the appended claims, the invention may be practised otherwise than as specifically described.

I claim:

1. A safety device for burning candles, comprising:

a fluid receiving vessel having a base, a sidewall, and an open top, said vessel having a supply of a vessel fluid contained therein;

a reflector container having a base, a sidewall, and an open top, said reflector being disposed inside of said vessel such that the reflector base rests on the vessel base, and the reflector sidewall is spaced inwardly from the vessel sidewall with the vessel fluid disposed therebetween, said reflector having a supply of a reflector fluid contained therein; and a reversible footed candle holder including a vertical body section having a first candle receiving recess formed in one end and a second candle receiving recess formed in the other end, said candle holder being disposed inside of said reflector such that the body section is spaced inwardly from the reflector sidewall with reflector fluid disposed therebetween, one end is supported on the reflector base wherein the first recess is downwardly directed with reflector fluid disposed therein, and the other end and the second recess are upwardly directed and are disposed to receive a candle.

2. The device of claim 1 wherein said first recess and said second recess have different widths and depths, thereby being sized to receive differently sized candles.

3. The device of claim 1 further including an insert candle holder including a vertical body section having a third candle receiving recess formed therein and being sized to be removably received in one of said first and second recesses.

4. The device of claim 3 wherein said third recess has a different width and depth than both said first and second recesses, thereby being sized to receive a differently sized candle.

5. The device of claim 1 wherein said vessel fluid is water.

6. The device of claim 5 wherein said vessel water is selectively colored to complement the color scheme of an area where the device is placed.

7. The device of claim 5 wherein the supply of vessel water is limited such that the weight of the volume of water displaced by the reflector does not exceed the weight of the reflector and its contents, thereby assuring that the reflector will rest on the base of the vessel and will not float.

8. The device of claim 1 wherein said reflector fluid is water.

9. The device of claim 8 wherein said reflector water is selectively colored to complement the color scheme of the area where the device is placed.

10. The device of claim 8 wherein the supply of reflector water is limited such that a reflector water level is below the top of the footed candle holder.

11. The device of claim 1 wherein said vessel is translucent.

12. The device of claim 11 wherein said vessel is transparent.

13. The device of claim 1 wherein said reflector is translucent.

14. The device of claim 13 wherein said reflector is transparent.

15. The device of claim 1 wherein said footed candle holder is translucent.

16. The device of claim 15 wherein said footed candle holder is transparent.

17. The device of claim 3 wherein said insert candle holder is translucent.

18. The device of claim 17 wherein said insert candle holder is transparent.

* * * * *